US010508256B2

(12) United States Patent
Wu

(10) Patent No.: US 10,508,256 B2
(45) Date of Patent: Dec. 17, 2019

(54) DETERGENT COMPOSITION AND MANUFACTURING METHOD THEREOF

(71) Applicant: Ming-Hsuan Wu, Taipei (TW)

(72) Inventor: Ming-Hsuan Wu, Taipei (TW)

( * ) Notice: Subject to any disclaimer, the term of this patent is extended or adjusted under 35 U.S.C. 154(b) by 101 days.

(21) Appl. No.: 15/960,606

(22) Filed: Apr. 24, 2018

(65) Prior Publication Data

US 2019/0249123 A1 Aug. 15, 2019

(30) Foreign Application Priority Data

Feb. 13, 2018 (TW) ..... 107105234 A

(51) Int. Cl.

| | |
|---|---|
| ***C11D 3/14*** | (2006.01) |
| ***C11D 17/00*** | (2006.01) |
| ***C11D 11/00*** | (2006.01) |
| ***C11D 3/382*** | (2006.01) |

(52) U.S. Cl.

CPC ..... *C11D 17/0017* (2013.01); *C11D 3/382* (2013.01); *C11D 11/0094* (2013.01); *C11D 17/0013* (2013.01)

(58) Field of Classification Search

CPC .... C11D 3/14; C11D 17/0017; C11D 17/0013
USPC ..... 510/130, 395
See application file for complete search history.

(56) References Cited

U.S. PATENT DOCUMENTS

| | | | | |
|---|---|---|---|---|
| 6,395,691 | B1 | 5/2002 | Tsaur | |
| 2015/0079012 | A1* | 3/2015 | Bellas | A61K 8/64 424/62 |
| 2015/0093446 | A1* | 4/2015 | Muller | A61K 8/97 424/535 |

FOREIGN PATENT DOCUMENTS

| | | | |
|---|---|---|---|
| CN | 1509163 | A | 6/2004 |
| KR | 10-2014-0065063 | A | 5/2014 |

* cited by examiner

*Primary Examiner* — Gregory E Webb
(74) *Attorney, Agent, or Firm* — Li & Cai Intellectual Property (USA) Office

(57) ABSTRACT

A detergent composition includes an aqueous phase, an oil phase and an emulsifying agent. The aqueous phase includes liquid water. The oil phase includes oil droplets and coffee grounds dispersed in the oil droplets. The composition of the oil droplets includes a foaming agent. In the detergent composition, the content of the liquid water ranges from 40 wt % to 60 wt %, the content of the foaming agent ranges from 15 wt % to 40 wt %, and the content of the coffee grounds ranges from 1 wt % to 10 wt %. The oil droplets are dispersed and suspended in the aqueous phase via the emulsifier molecules to enable the detergent composition to be in the form of oil-in-water, and to enable the coffee grounds to be covered by the oil droplets and to be isolated from the aqueous phase. In addition, the present disclosure also provides a manufacturing method of a detergent composition.

16 Claims, 2 Drawing Sheets

DETERGENT COMPOSITION AND MANUFACTURING METHOD THEREOF

BACKGROUND OF THE INVENTION

1. Field of the Invention

The present disclosure relates to a detergent composition and a manufacturing method thereof, and in particular, to a detergent composition having the exfoliating capability and a manufacturing method thereof.

2. Description of Related Art

Soft beads are often added to the composition of conventional detergent products, such as body wash, hand wash, or face wash, so as to achieve skin exfoliation. However, since the soft beads are plastic particles made of polyethylene, polypropylene, or nylon, the soft beads may flow through the sewer and eventually into the ocean after the detergent products are used, thereby having a great impact on the environment.

In this regard, the present disclosure provides a detergent composition and a manufacturing method thereof to overcome the aforementioned drawbacks.

SUMMARY OF THE INVENTION

The main object of the present disclosure is to solve the drawbacks associated with the prior art.

The present disclosure provides a detergent composition, includes: an aqueous phase including liquid water; in which the content of the liquid water in the detergent composition ranges from 40 wt % to 60 wt %; an oil phase including a plurality of oil droplets and coffee grounds respectively dispersed in the oil droplets, and the composition of the oil droplets including a foaming agent; in which the content of the foaming agent in the detergent composition ranges from 15 wt % to 40 wt %, and the content of the coffee grounds in the detergent composition ranges from 1 wt % to 10 wt %; and an emulsifying agent including a plurality of emulsifier molecules, and each of the emulsifier molecules having a hydrophilic end and a lipophilic end; in which the oil droplets are dispersed and suspended in the aqueous phase via the emulsifier molecules to enable the aqueous phase to be formed as a continuous phase, to enable the oil phase to be formed as a discontinuous phase, and to enable the detergent composition to be in the form of oil-in-water; and in which the hydrophilic ends of the emulsifier molecules are located in the aqueous phase, the lipophilic ends of the emulsifier molecules are respectively located in the oil droplets, and the coffee grounds are respectively covered by the oil droplets and are isolated from the aqueous phase.

The present disclosure also provides a manufacturing method of a detergent composition, including: implementing a first mixing step including mixing liquid water and an emulsifying agent to form an aqueous phase solution; implementing a second mixing step including mixing a foaming agent and coffee grounds to form an oil phase solution; and implementing a third mixing step including pouring the oil phase solution into the aqueous phase solution, and mixing the oil phase solution and the aqueous phase solution to form a detergent composition including an aqueous phase, an oil phase, and the emulsifying agent; in which in the detergent composition, the content of the liquid water ranges from 40 wt % to 60 wt %, the content of the foaming agent ranges from 15 wt % to 40 wt %, and the content of the coffee grounds ranges from 1 wt % to 10 wt %; and in which the third mixing step and the content of each composition of the detergent composition enable the oil phase to be formed into a plurality of oil droplets dispersed and suspended in the aqueous phase, enable the coffee grounds to be respectively dispersed in the oil droplets and covered by the oil droplets, and enable the coffee grounds to be isolated from the aqueous phase.

The advantage of the present disclosure is that the detergent composition and the manufacturing thereof of the present embodiment can improve the cleansing and exfoliating capabilities of the detergent composition by virtue of the oil phase including the coffee grounds. In addition, the detergent composition has the advantages of being environment-friendly and non-toxic. In addition, the detergent composition and the manufacturing method thereof of the present embodiment enables the coffee grounds to be isolated from the aqueous phase and to be uniformly dispersed and suspended in the detergent composition by virtue of the detergent composition being in the form of oil-in-water (O/W) and by virtue of the coffee grounds being respectively dispersed in the oil droplets and covered by the oil droplets. Further, the detergent composition of the present embodiment can prevent the coffee grounds from absorbing the water in the aqueous phase so as to avoid precipitation and storage problems of the coffee grounds.

For further understanding of the present disclosure, the following embodiments are provided to facilitate the disclosure of the present disclosure.

DETAILED DESCRIPTION OF PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings. In addition, for an easy instruction, similar reference numbers or symbols refer to elements alike.

[Detergent Composition]

The present embodiment discloses a detergent composition 100. The detergent composition 100 may be a detergent product for use on the human body, such as body wash, hand wash, face wash, or shampoo, but the present disclosure is not limited thereto. For example, the detergent composition 100 may also be a detergent product for use on an animal body or may also be a detergent product for cleaning articles, such as dishes.

Figure 1:
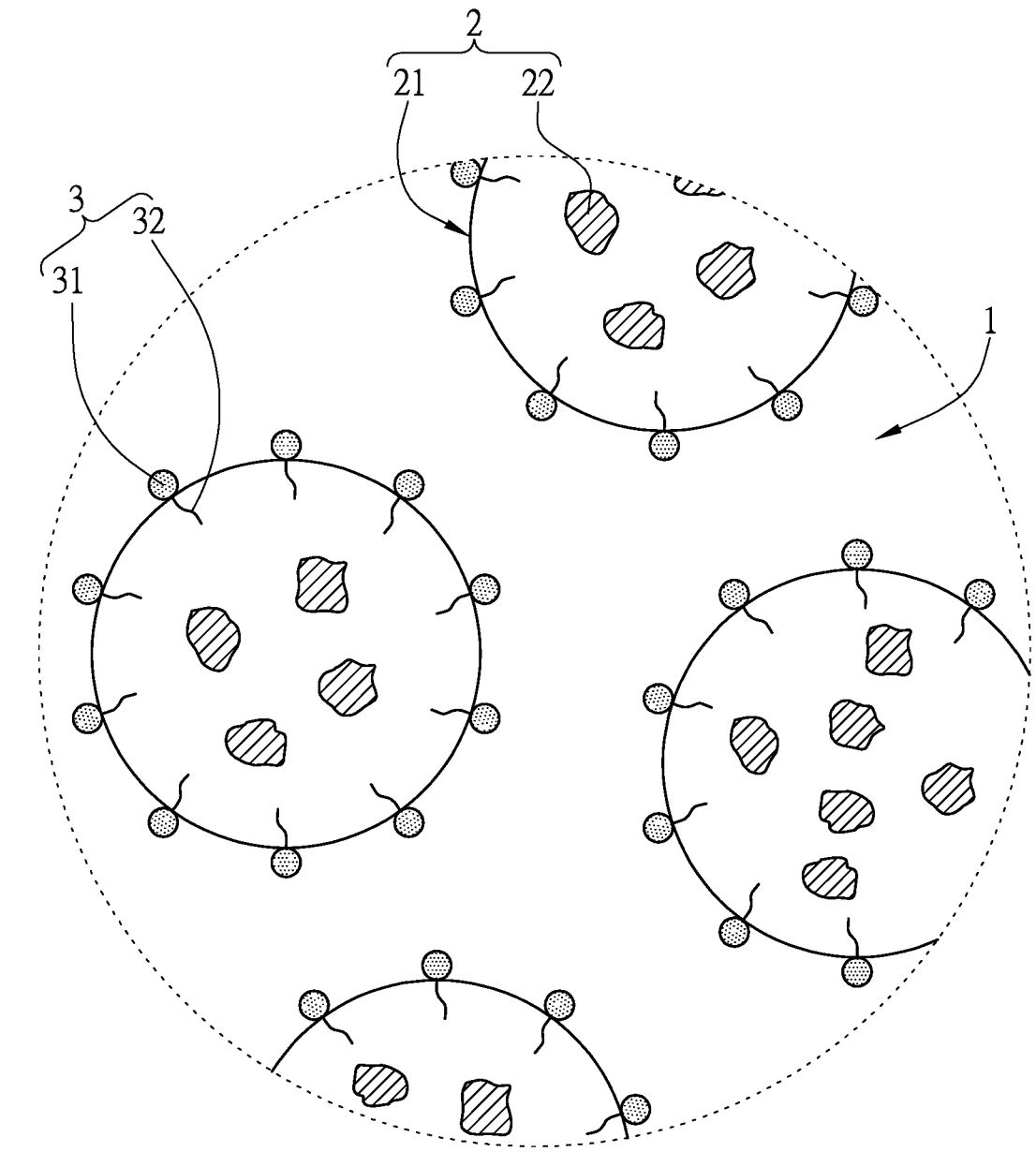
FIG. 1 is a perspective view of a detergent composition according to an embodiment of the present disclosure.

Referring to FIG. 1, the detergent composition 100 includes an aqueous phase 1, an oil phase 2, and an emulsifying agent. The aqueous phase 1 includes liquid water, and the content of the liquid water in the detergent composition 100 ranges from 40 wt % to 60 wt %. Preferably, the content of the liquid water in the detergent composition 100 ranges from 45 wt % to 50 wt %.

The oil phase 2 includes a plurality of oil droplets 21 and coffee grounds 22 (i.e. used/spent coffee grounds 22) respectively dispersed in the oil droplets 21. The composition of the oil droplets 21 includes a foaming agent, the content of the foaming agent in the detergent composition 100 ranges from 15 wt % to 40 wt %, and the content of the coffee grounds 22 in the detergent composition 100 ranges from 1 wt % to 10 wt %. Preferably, the content of the foaming agent in the detergent composition 100 ranges from 20 wt % to 25 wt %, and the content of the coffee grounds 22 in the detergent composition 100 ranges from 2 wt % to 5 wt %. It should be noted that the term "coffee grounds" as used herein refers to the spent (used) residue of the coffee beans remaining after extraction of the soluble components used for producing water-soluble coffee powders. Further, in the present embodiment, the foaming agent includes about 20 wt % of coconut oil foaming agent (i.e. cocamidopropyl betaine, CAPB) and 5 wt % of amino acid foaming agent (i.e. sodium lauroyl glutamate or sodium cocoyl glutamate), but the present disclosure is not limited thereto. For example, the foaming agent may also be at least one of the coconut oil foaming agent and the amino acid foaming agent, or the foaming agent may also be other kinds of foaming agents with similar properties, such as weak acid foaming agent (i.e. ammonium lauryl sulfate) or olive oil foaming agent (i.e. sodium PEG-7 olive oil carboxylate). In addition, the coffee grounds 22 are preferably the coffee grounds 22 which have been extracted and dried, and the particle sizes of the coffee grounds 22 are respectively less than the particle sizes of the oil droplets 21, and are between 0.2 millimeter and 1.0 millimeter (200 micrometer and 1,000 micrometer). More preferably, the particle sizes of the coffee grounds 22 are between 0.2 millimeter and 0.4 millimeter (200 micrometer and 400 micrometer).

The emulsifying agent includes a plurality of emulsifier molecules 3. Each of the emulsifier molecules 3 has a hydrophilic end 31 and a lipophilic end 32 (as shown in FIG. 1), the hydrophilic end 31 can be combined with the aqueous phase 1, and the lipophilic end 32 can be combined with the oil droplet 21. The content of the emulsifying agent in the detergent composition 100 ranges from 2 wt % to 5 wt %. In the present embodiment, the emulsifying agent is a non-ionic surfactant, and the non-ionic surfactant is preferably polyoxyethylene (20) sorbitan monooleate (i.e. tween 80), but the present disclosure is not limited thereto. As long as the emulsifying agent is a hydrophilic emulsifying agent or an oil-in-water (O/W) emulsifying agent, and the hydrophilic/lipophilic balance (HLB) of the emulsifying agent is approximately between 7 and 18, they all conform to the spirit of the present disclosure and fall under the scope of the present disclosure.

Further referring to FIG. 1, more specifically, the oil droplets 21 are respectively dispersed and suspended in the aqueous phase 1 via the emulsifier molecules 3, and the specific gravities of the oil droplets 21 are less than or equal to the specific gravity of the aqueous phase 1 so that the aqueous phase is formed as a continuous phase, the oil phase is formed as a discontinuous phase, and the detergent composition 100 is in the form of oil-in-water (O/W). In addition, the hydrophilic ends 31 of the emulsifier molecules 3 are located in the aqueous phase 1, the lipophilic ends 32 of the emulsifier molecules 3 are respectively located in the oil droplets 21, and the coffee grounds 22 are respectively covered by the oil droplets 21 and are isolated from the aqueous phase 1.

Therefore, the detergent composition 100 of the present embodiment can improve the cleansing and exfoliating capabilities of the detergent composition 100 by virtue of the oil phase 2 including the coffee grounds 22. In addition, the detergent composition 100 has the advantages of being environment-friendly and non-toxic.

It is worth mentioning that when simply mixing the coffee grounds 22 into the general detergent, the coffee grounds 22 may absorb the water in the aqueous phase, thereby causing precipitation and storage problems of the coffee grounds 22. Relative to the drawbacks described above, the detergent composition 100 of the present embodiment enables the coffee grounds 22 to be isolated from the aqueous phase 1 and to be uniformly dispersed and suspended in the detergent composition 100 by virtue of the detergent composition 100 being in the form of oil-in-water (O/W) and by virtue of the coffee grounds 22 being respectively dispersed in the oil droplets 21 and covered by the oil droplets 21. Further, the detergent composition 100 of the present embodiment can prevent the coffee grounds 22 from absorbing the water in the aqueous phase so as to avoid the precipitation and storage problems of the coffee grounds 22.

In addition, since the coffee grounds 22 of the present embodiment are the coffee grounds 22 which have been extracted and dried, the compatibility between the coffee grounds 22 and the oil droplets 21 can be improved (since the oily components of the coffee grounds 22 are extracted and formed on the outer layer of the coffee grounds 22), and the specific gravities of the coffee grounds 22 can be reduced (since the water content of the coffee grounds 22 is reduced). Therefore, the coffee grounds 22 can be more uniformly dispersed and suspended in the detergent composition 100.

It is worth mentioning that the coffee grounds 22 of the present embodiment has a preferred content range (1 wt % to 10 wt %) and a preferred particle size range (0.2 millimeter to 1.0 millimeter). If the content or the particle sizes of the coffee grounds 22 exceed the above range, the product quality or performance of the detergent composition 100 may be reduced. For example, if the content of the coffee grounds 22 is less than 1 wt % or the particle sizes of the coffee grounds 22 are less than 0.2 millimeter, the cleansing and exfoliating capability of the detergent composition 100 may be reduced. Relatively, if the content of the coffee grounds 22 is greater than 10 wt % or the particle sizes of the coffee grounds 22 are greater than 1.0 millimeter, the coffee grounds 22 may be precipitated, reduced in preservability, or excessively viscous.

In one embodiment of the present disclosure, the aqueous phase 1 further includes a bubble generating agent and an antibacterial agent to increase the foaming ability and the preservability of the detergent composition 100. In the detergent composition 100, the content of the bubble generating agent ranges from 2 wt % to 5 wt %, and the content of the antibacterial agent ranges from 0.1 wt % to 1 wt %. In addition, the bubble generating agent is sodium lauryl sulfate (SLS), and the antibacterial agent is dimethylol dimethyl hydantoin (DMDMH). Moreover, the aqueous phase 1 further includes appropriate amounts of a main moisturizing ingredient (i.e. about 10 wt % of glycerol), other moisturizing ingredients (i.e. propylene glycol, butylene glycol, sodium pyrrolidone carboxylate PCA-Na, sodium lactate), a chelating agent (i.e. tetrasodium ethylenediaminetetra-acetate EDTA-4N), and a lubricant (i.e. lauric acid) to increase the moisture retention and the uniformity of the detergent composition 100, but the present disclosure is not limited thereto.

In another embodiment of the present disclosure, the oil phase 2 further includes a thickening agent to increase the consistency and the lubricity of the detergent composition 100. In the detergent composition 100, the content of the thickening agent ranges from 1 wt % to 10 wt %. In addition, the thickening agent is at least one of soyamide DEA (i.e. soybean oil diethanolamide), cocamide DEA (i.e. coco diethanolamide), and sodium chloride. Moreover, the oil phase 2 further includes appropriate amounts of a brightening agent (about 3 wt % of ethylene glycol distearate, i.e. pearl sauce) and flavors to increase the gloss and the aroma of the detergent composition 100, but the present disclosure is not limited thereto.

[Manufacturing Method of Detergent Composition]

The above description is the configuration and the composition of the detergent composition 100 of the present embodiment, and a manufacturing method of the detergent composition 100 will be described below.

Figure 2:
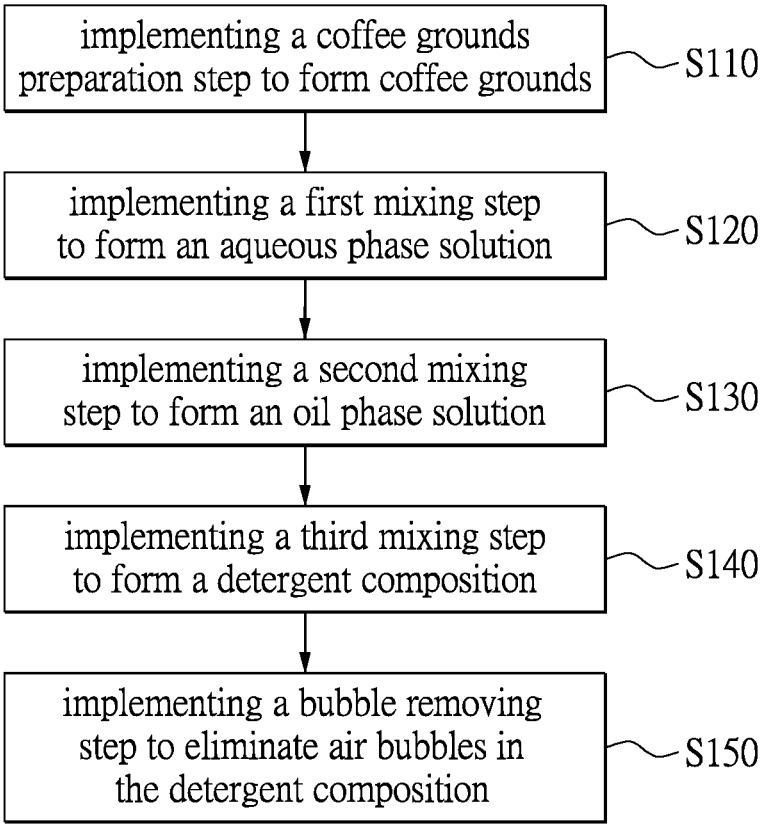
FIG. 2 is a flow chart of a method of a manufacturing method of the detergent composition according to the embodiment of the present disclosure.

Referring to FIG. 2, the present embodiment discloses the manufacturing method of the detergent composition. The manufacturing method of the detergent composition includes step 110, step 120, step 130, step 140, and step 150. It should be noted that the order and operation of the steps described in the present embodiment can be adjusted according to requirements, and the present disclosure is not limited thereto.

Step 110 is to implement a coffee grounds preparation step to form coffee grounds 22. More specifically, the coffee grounds preparation step includes: providing a plurality of coffee beans; baking the coffee beans (i.e. deep roasting) and grinding the coffee beans to form coffee powders; extracting the coffee powders under high temperature (85□ to 95□) and high pressure to form the coffee grounds 22; drying the coffee grounds 22 (i.e. drying the coffee grounds 22 under the sun or in an oven) to reduce the water content of the coffee grounds 22; and screening the coffee grounds 22 (e.g., by sieving or the like) to retain the coffee grounds 22 having a particle size between 0.2 millimeter (mm) and 1.0 millimeter (mm).

Step 120 is to implement a first mixing step to form an aqueous phase solution. More specifically, the first mixing step includes: pouring the liquid water according to the above content range into a first container for heating (a heating temperature of about 75□ to 85□), and stirring with a homogenizing and emulsifying device; and then sequentially pouring the main moisturizing ingredient (i.e. glycerol), the bubble generating agent (i.e. sodium lauryl sulfate, SLS), the other moisturizing ingredients (i.e. propylene glycol, butylene glycol, sodium pyrrolidone carboxylate PCA-Na, sodium lactate), the antibacterial agent (i.e. dimethylol dimethyl hydantoin), the chelating agent (i.e. tetrasodium ethylenediaminetetra-acetate) a lubricant (i.e. lauric acid), and the emulsifying agent (i.e. polyoxyethylene (20) sorbitan monooleate) into the first container according to the above content range of each composition and under continuous stirring and continuous heating to form the aqueous phase solution.

Step 130 is to implement a second mixing step to form an oil phase solution. More specifically, the second mixing step includes: pouring the foaming agent (i.e. the coconut oil foaming agent and the amino acid foaming agent) according to the above content range into a second container, and stirring with a stirring device; and then sequentially pouring the brightening agent (i.e. ethylene glycol distearate), the thickening agent (i.e. soyamide DEA, cocamide DEA, and sodium chloride), the coffee grounds 22, and the flavors into the second container according to the above content range of each composition and under continuous stirring and partial heating to form the oil phase solution.

It should be noted that, although the first mixing step and the second mixing step of the present embodiment are described with the above-mentioned ingredients and order, the present disclosure is not limited thereto. For example, the first mixing step may merely include: mixing the liquid water and the emulsifying agent to form the aqueous phase solution, and the first mixing step is not limited to stirring with the homogenizing and emulsifying device. Further, the second mixing step may merely include mixing the foaming agent and the coffee grounds 22 to form the oil phase solution, and the second mixing step is not limited to stirring with the stirring device.

Step 140 is to implement a third mixing step to form a detergent composition 100. More specifically, the third mixing step includes: slowly pouring the oil phase solution into the aqueous phase solution, and mixing (stirring) the oil phase solution and the aqueous phase solution by the stirring device to form the detergent composition 100 which includes an aqueous phase 1, an oil phase 2, and the emulsifying agent. The third mixing step and the content of each composition of the detergent composition 100 enable the oil phase 2 to be formed into a plurality of oil droplets 21 dispersed and suspended in the aqueous phase 1, enable the coffee grounds 22 to be respectively dispersed in the oil droplets 21 and covered by the oil droplets 21, and enable the coffee grounds 22 to be isolated from the aqueous phase 1. Accordingly, the coffee grounds 22 can be uniformly dispersed and suspended in the detergent composition 100, and the precipitation and storage problems of the coffee grounds 22 can be avoided.

It is worth mentioning that since the detergent composition 100 may generate a lot of air bubbles during stirring, the manufacturing method of the detergent composition can preferably include implementing a bubble removing step (Step 150) after the third mixing step. More specifically, the bubble removing step includes: resting the detergent composition 100 for 24 hours to 72 hours to eliminate the air bubbles in the detergent composition 100, but the present disclosure is not limited thereto. For example, when the homogenizing and emulsifying device adopted in each of the above mixing steps is a vacuum homogenizing and emulsifying device and the stirring device is a vacuum stirring device, the manufacturing method of the detergent composition may need not include the bubble removing step.

Advantageous Effect of the Present Disclosure

As described above, the detergent composition 100 and the manufacturing thereof of the present embodiment can improve the cleansing and exfoliating capabilities of the detergent composition 100 by virtue of the oil phase 2 including the coffee grounds 22. In addition, the detergent composition 100 has the advantages of being environment-friendly and non-toxic. In addition, the detergent composition 100 and the manufacturing method thereof of the present embodiment enables the coffee grounds 22 to be isolated from the aqueous phase 1 and to be uniformly dispersed and suspended in the detergent composition 100 by virtue of the detergent composition 100 being in the form of oil-in-water (O/W) and by virtue of the coffee grounds 22 being respectively dispersed in the oil droplets 21 and covered by the oil droplets 21. Further, the detergent composition 100 of the present embodiment can prevent the coffee grounds 22 from absorbing the water in the aqueous phase so as to avoid the precipitation and storage problems of the coffee grounds 22.

The descriptions illustrated supra set one simply the preferred embodiment of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A detergent composition, comprising:

an aqueous phase including liquid water; wherein the content of the liquid water in the detergent composition ranges from 40 wt % to 60 wt %;

an oil phase including a plurality of oil droplets and coffee grounds respectively dispersed in the oil droplets, and the composition of the oil droplets including a foaming agent; wherein the content of the foaming agent in the detergent composition ranges from 15 wt % to 40 wt %, and the content of the coffee grounds in the detergent composition ranges from 1 wt % to 10 wt %; and an emulsifying agent including a plurality of emulsifier molecules, and each of the emulsifier molecules having a hydrophilic end and a lipophilic end;

wherein the oil droplets are dispersed and suspended in the aqueous phase via the emulsifier molecules to enable the aqueous phase to be formed as a continuous phase, to enable the oil phase to be formed as a discontinuous phase, and to enable the detergent composition to be in the form of oil-in-water;

wherein the hydrophilic ends of the emulsifier molecules are located in the aqueous phase, the lipophilic ends of the emulsifier molecules are respectively located in the oil droplets, and the coffee grounds are respectively covered by the oil droplets and are isolated from the aqueous phase.

2. The detergent composition according to claim 1, wherein the coffee grounds are coffee grounds which have been extracted and dried, the particle sizes of the coffee grounds are respectively less than the particle sizes of the oil droplets, the particle sizes of the coffee grounds are between 0.2 millimeter (mm) and 1.0 millimeter (mm), and the specific gravities of the oil droplets are less than or equal to the specific gravity of the aqueous phase.

3. The detergent composition according to claim 1, wherein the foaming agent is at least one of a coconut oil foaming agent and an amino acid foaming agent, and the emulsifying agent is a non-ionic surfactant and is polyoxyethylene (20) sorbitan monooleate; wherein the content of the emulsifying agent in the detergent composition ranges from 2 wt % to 5 wt %.

4. The detergent composition according to claim 1, wherein the aqueous phase further includes a bubble generating agent and an antibacterial agent, the bubble generating agent is sodium lauryl sulfate, and the antibacterial agent is dimethylol dimethyl hydantoin; wherein the content of the bubble generating agent in the detergent composition ranges from 2 wt % to 5 wt %, and the content of the antibacterial agent in the detergent composition ranges from 0.1 wt % to 1 wt %; wherein the oil phase further includes a thickening agent, and the thickening agent is at least one of soyamide DEA, cocamide DEA, and sodium chloride; wherein the content of the thickening agent in the detergent composition ranges from 1 wt % to 10 wt %.

5. A manufacturing method of a detergent composition, comprising:

implementing a first mixing step including: mixing liquid water and an emulsifying agent to form an aqueous phase solution;

implementing a second mixing step including: mixing a foaming agent and coffee grounds to form an oil phase solution; and implementing a third mixing step including: pouring the oil phase solution into the aqueous phase solution, and mixing the oil phase solution and the aqueous phase solution to form a detergent composition including an aqueous phase, an oil phase, and the emulsifying agent;

wherein in the detergent composition, the content of the liquid water ranges from 40 wt % to 60 wt %, the content of the foaming agent ranges from 15 wt % to 40 wt %, and the content of the coffee grounds ranges from 1 wt % to 10 wt %;

wherein the third mixing step and the content of each composition of the detergent composition enable the oil phase to be formed into a plurality of oil droplets dispersed and suspended in the aqueous phase, enable the coffee grounds to be respectively dispersed in the oil droplets and covered by the oil droplets, and enable the coffee grounds to be isolated from the aqueous phase.

6. The manufacturing method of the detergent composition according to claim 5, wherein the coffee grounds is formed by a coffee grounds preparation step, and the coffee grounds preparation step includes: providing a plurality of coffee beans; baking and grinding the coffee beans to form coffee powders; extracting the coffee powders to form the coffee grounds; drying the coffee grounds to reduce the water content of the coffee grounds; and screening the coffee grounds to retain the coffee grounds having a particle size between 0.2 millimeter (mm) and 1.0 millimeter (mm).

7. The manufacturing method of the detergent composition according to claim 5, wherein the foaming agent is at least one of a coconut oil foaming agent and an amino acid foaming agent, and the emulsifying agent is a non-ionic surfactant and is polyoxyethylene (20) sorbitan monooleate; wherein the content of the emulsifying agent in the detergent composition ranges from 2 wt % to 5 wt %.

8. The manufacturing method of the detergent composition according to claim 5, wherein the first mixing step further includes: mixing a bubble generating agent and an antibacterial agent into the aqueous phase solution; wherein the bubble generating agent is sodium lauryl sulfate, the antibacterial agent is dimethylol dimethyl hydantoin, the content of the bubble generating agent in the detergent composition ranges from 2 wt % to 5 wt %, and the content of the antibacterial agent in the detergent composition ranges from 0.1 wt % to 1 wt %; wherein the second mixing step further includes: mixing a thickening agent into the oil phase solution; wherein the thickening agent is at least one of soyamide DEA, cocamide DEA, and sodium chloride, and the content of the thickening agent in the detergent composition ranges from 1 wt % to 10 wt %.

9. The manufacturing method of the detergent composition according to claim 5, wherein the first mixing step adopts a homogenizing and emulsifying device to stir the aqueous phase solution, the second mixing step adopts a stirring device to stir the oil phase solution, and the third mixing step adopts the stirring device to stir the detergent composition.

10. The manufacturing method of the detergent composition according to claim 9, further comprising: implementing a bubble removing step which includes resting the detergent composition for 24 hours to 72 hours to eliminate air bubbles in the detergent composition.

11. The manufacturing method of the detergent composition according to claim 6, wherein the first mixing step adopts a homogenizing and emulsifying device to stir the aqueous phase solution, the second mixing step adopts a stirring device to stir the oil phase solution, and the third mixing step adopts the stirring device to stir the detergent composition.

12. The manufacturing method of the detergent composition according to claim 11, further comprising: implementing a bubble removing step which includes resting the detergent composition for 24 hours to 72 hours to eliminate air bubbles in the detergent composition.

13. The manufacturing method of the detergent composition according to claim 7, wherein the first mixing step adopts a homogenizing and emulsifying device to stir the aqueous phase solution, the second mixing step adopts a stirring device to stir the oil phase solution, and the third mixing step adopts the stirring device to stir the detergent composition.

14. The manufacturing method of the detergent composition according to claim 13, further comprising: implementing a bubble removing step which includes resting the detergent composition for 24 hours to 72 hours to eliminate air bubbles in the detergent composition.

15. The manufacturing method of the detergent composition according to claim 8, wherein the first mixing step adopts a homogenizing and emulsifying device to stir the aqueous phase solution, the second mixing step adopts a stirring device to stir the oil phase solution, and the third mixing step adopts the stirring device to stir the detergent composition.

16. The manufacturing method of the detergent composition according to claim 15, further comprising: implementing a bubble removing step which includes resting the detergent composition for 24 hours to 72 hours to eliminate air bubbles in the detergent composition.

* * * * *